United States Patent [19]

Manso

[11] 4,436,271

[45] Mar. 13, 1984

[54] BOOK HOLDING DEVICE

[76] Inventor: Hipolito S. Manso, 95 Ten Eyck Walk, Apt. 73, Brooklyn, N.Y. 11206

[21] Appl. No.: 398,986

[22] Filed: Jul. 16, 1982

[51] Int. Cl.[3] ..... A47B 97/04

[52] U.S. Cl. ..... 248/460; 248/452; 248/456

[58] Field of Search ..... 248/441 R, 460, 447, 248/451, 452, 453, 454, 455, 456, 457, 463, 465

[56] References Cited

U.S. PATENT DOCUMENTS

| | | | |
|---|---|---|---|
| 456,089 | 7/1891 | Harrison | 248/452 |
| 1,483,396 | 2/1924 | Terrell | 248/451 |
| 2,219,091 | 10/1940 | Henderson | 248/452 |
| 2,501,019 | 3/1950 | Attick | 248/453 X |
| 3,954,246 | 5/1976 | Sparkman | 248/460 X |
| 3,991,967 | 11/1976 | Sack | 248/453 X |
| 4,150,807 | 4/1979 | Manso | 248/460 X |
| 4,323,214 | 4/1982 | DeLuca | 248/452 |

FOREIGN PATENT DOCUMENTS

| | | | |
|---|---|---|---|
| 525298 | 8/1940 | United Kingdom | 248/451 |

*Primary Examiner*—J. Franklin Foss

[57] ABSTRACT

This device is for holding a book open to a desired page, while leaving the user's hands free. Primarily, it consists of a base, having a hinged rod assembly secured to it. The assembly includes a pair of plastic sleeves with an adjustable and elevatable upper hook arrangement, for holding a book open, and the hinged rod assembly further includes an adjustable lower hook arrangement for holding the lower portions of the pages open.

1 Claim, 2 Drawing Figures

FIG. 1
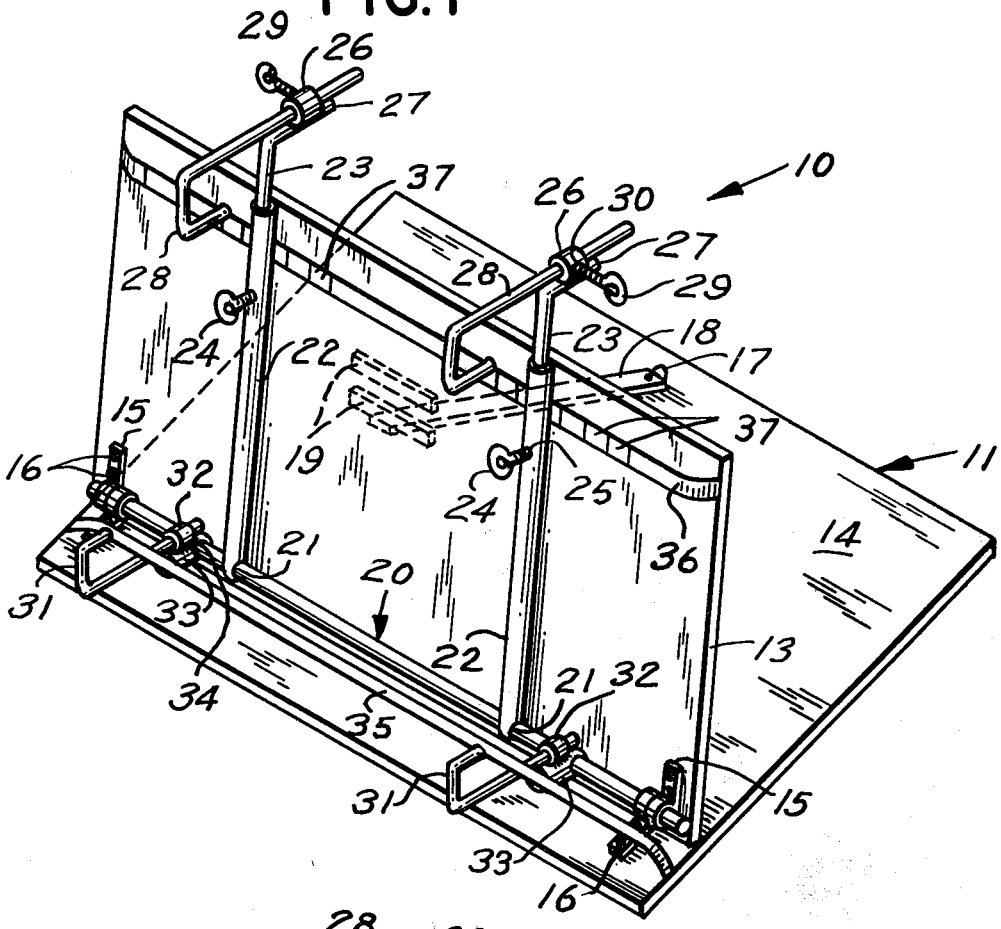
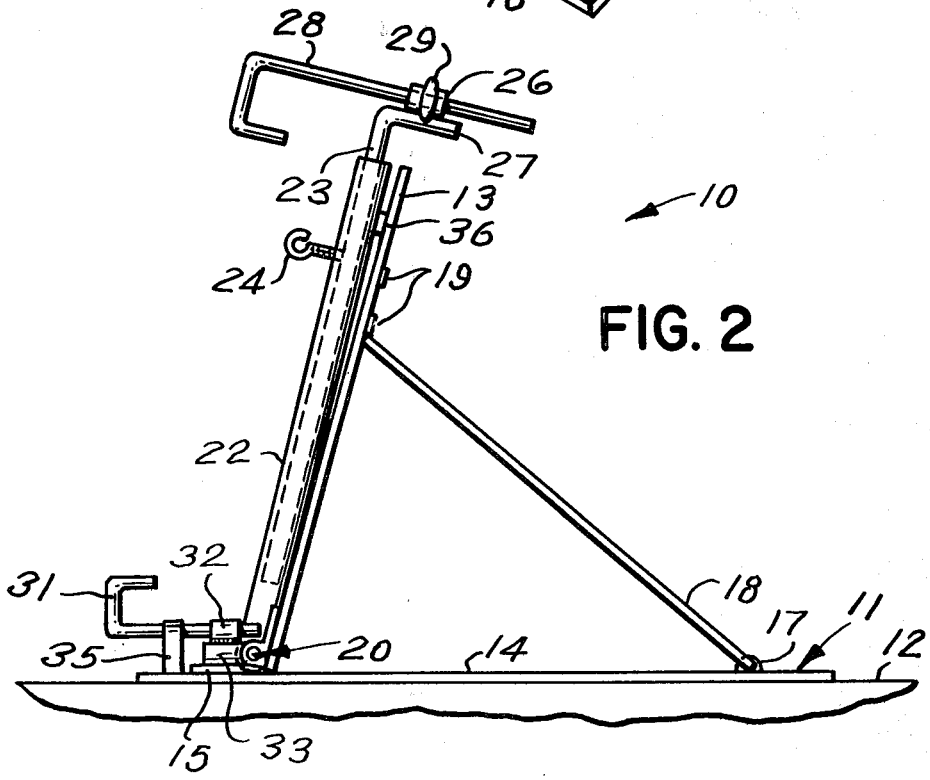
FIG. 2

BOOK HOLDING DEVICE

This invention relates to support devices, and more particularly, to a book holding device.

The principal object of this invention is to provide a book holding device, which will be an improved design of the Hipolito S. Manso U.S. Pat. No. 4,150,807, issued Apr. 24, 1979.

Another object of this invention is to provide a book holding device, which will support a book or the like, without the user having to hold it, and it will enable the user to have the hands free, so as to take down notes from the book.

A further object of this invention is to provide a book holder, which will include a pair of elevatable upper members, for holding the pages of the book stationary, and the elevatable members will be mounted to the device, so as to be spread apart to receive books of various widths.

A still further object of this invention is to provide a book holder, which will also include an adjustable pair of lower members, for holding the bottom portions of the pages open.

Other objects of the present invention are to provide a book holding device, which is simple in design, inexpensive to manufacture, rugged in construction, easy to use and efficient in operation.

These, and other objects, will be readily evident upon a study of the following specification and the accompanying drawing wherein:

FIG. 1 is a perspective view of the present invention, and

FIG. 2 is a side view of FIG. 1, showing the invention resting on a surface, which is shown fragmentary.

According to this invention, a book holding device 10 is shown to include a flat rectangular base 11, for resting upon a desired surface 12. A rectangular configurated panel 13 is hinged to the forward portion of the top surface 14 of base 11, by a hinge 15 near each end, and the pair of hinges 15 are secured to top surface 14, by a plurality of suitable screw fasteners 16. A "U"-shaped staple 17 is fixedly secured to surface 14 near the rear longitudinal edge of base 11, and is freely received in one end of a brace 18, and the opposite end of brace 18 is removably received between a pair of parallel spaced-apart strips 19, which are fixedly secured to the rear of panel 13 in a suitable manner. Brace 18 serves to support panel 13 at an angle, and the free end of brace 18 may also be placed below the bottom strip 19, for decreasing the angle of panel 13, as is illustrated in the drawing. Hinges 15 are of such design, that they receive the end portions of axle rod 20, which is freely received in an end opening 21 of a pair of parallel spaced-apart plastic sleeves 22, and sleeves 22 freely and slidably receive an "L"-shaped rod 23, which is adjustable in elevation, by means of screw eyes or thumb screws 24, which are threadingly received in an opening 25 of sleeves 22. A bushing 26 is fixedly secured at its outer periphery to ends 27 of rods 23 by suitable means, and bushings 26 freely and slidably receive hooks 28, which are held at any desired position forwardly or rearwardly, by screw eyes or thumb screws 29, that are threadingly received in threaded openings 30 of bushings 26. Hooks 28 serve to hold the pages of a book open, which is not shown, and a pair of bottom hooks 31 are freely received in bushings 32, which are fixedly secured to sleeves 33 in a suitable manner. Hooks 31 serve to hold the bottom portion of the book pages open, and rod 20 is freely received in the transverse openings 34 of sleeves 33, so as to enable hooks 31 to be closed together or be spread apart to fit books of various widths. To prevent interference with hooks 31, a raised plastic strip 35 is fixedly secured at each end, to the side edges of base 11, for serving as a rest for the bottom of the book, and hooks 31 are spaced below strip 35, so as to enable complete freedom of movement for the hooks 31. A raised plastic strip 36 is also fixedly secured at each end to the side edges of panel 13 near its top edge, and strip 36 includes a plurality of plastic segments 37 thereon, for preventing the upper ends of sleeves 22 from pivoting to the side.

In use, device 10 is first unfolded by pivoting panel 13 upward from its base 11. The brace 18 is then pivoted upward, and its free end is placed beneath the bottom strip 19, or between the top and bottom strips 19, so as to support a book at either angle desired. The book is then placed at the front face of the panel 13 assembly, and, depending on the height and width of the book, the rods 23 are adjusted to the proper elevation, and rendered secure by the screw eyes 24, so as to enable the upper hooks 28 to engage and hold the pages where desired. The hooks 28 are also moved forward or rearward, so as to engage the pages properly, and they are rendered secured by the screw eyes 29. The bottom hooks 31 are also moved forward or backward in their bushings 32, to accommodate the bottom portion of the book. The hooks 31 can then be brought closer together or spread apart, as desired, on the rod 20, and the sleeves 22 may also be spread or closed together on the rod 20, to adjust the hooks 28 for dimension of the book.

While various changes may be made in the detail construction, it is understood that such changes will be within the spirit and scope of the present invention, as is defined by the appended claims.

What I now claim is:

1. A book holding device, comprising, in combination, a flat base, a panel hinged by means of a pair of spaced-apart hinges upon a forward portion of said base, a plurality of spaced-apart cleats on a rear side of said panel, a brace pivoted upon a rear portion of said base for being propped under a selected one of said cleats, an elongated axle rod forming a single hinge pin extending through both said hinges, a pair of sleeves each having a transverse hole therethrough for being slidable along said axle rod, and in front of a front side of said panel, an "L"-shaped rod adjustably secured in an upper end of each said sleeve, a forwardly extending upper hook adjustably carried by each said "L"-shaped rod, a pair of bushing sleeves slidable along said axle rod, a bushing affixed on each said bushing sleeve, a forwardly extending lower hook adjustably carried by each said bushing, a horizontal book rest located forwardly of a lower portion of said sleeves and supported at opposite ends upon opposite ends of said base forward portion, and a horizontal bar extending across a front upper portion of said panel being located between said panel and the first said sleeves, a plurality of plastic segments being along a front side of said bar.

* * * * *